United States Patent [19]

Wesselink

[11] Patent Number: 4,571,526

[45] Date of Patent: Feb. 18, 1986

[54] LOW-PRESSURE DISCHARGE LAMP WITH COOLED INTERNAL BALLAST

[75] Inventor: Gustaaf A. Wesselink, Eindhoven, Netherlands

[73] Assignee: U.S. Philips Corporation, New York, N.Y.

[21] Appl. No.: 757,760

[22] Filed: Jul. 22, 1985

Related U.S. Application Data

[63] Continuation of Ser. No. 698,277, Feb. 5, 1985, abandoned, which is a continuation of Ser. No. 548,054, Nov. 17, 1983, abandoned, which is a continuation of Ser. No. 294,868, Aug. 21, 1981, Pat. No. 4,455,508.

[30] Foreign Application Priority Data

Sep. 11, 1980 [NL] Netherlands ..... 8005112

[51] Int. Cl.[4] ..... H01J 25/50

[52] U.S. Cl. ..... 315/56; 313/46; 313/493; 315/50; 315/58

[58] Field of Search ..... 315/50, 56, 58; 313/493, 46

[56] References Cited

U.S. PATENT DOCUMENTS

| | | | |
|---|---|---|---|
| 2,401,637 | 6/1946 | Harries | 315/50 |
| 3,089,979 | 5/1963 | Lovinger | 315/DIG. 2 |
| 3,899,712 | 8/1975 | Witting | 315/59 |
| 3,974,418 | 8/1976 | Fridrich | 315/50 |
| 4,196,374 | 4/1980 | Witting | 315/58 |
| 4,300,073 | 11/1981 | Skwirut et al. | 315/50 |
| 4,383,200 | 5/1983 | Van Zon et al. | 315/50 |

*Primary Examiner*—Harold Dixon
*Attorney, Agent, or Firm*—David R. Treacy

[57] ABSTRACT

A compact screw-base discharge lamp having an electrical stabilization ballast which occupies a central position in the lamp. The discharge vessel surrounds the ballast. To dissipate the heat generated by the ballast during operation to the environment of the lamp, a thin-walled heat sink of a heat-conductive material is provided between the ballast and the discharge vessel, and bears on the ballast. This body has a collar which extends to the exterior of the lamp.

4 Claims, 3 Drawing Figures

LOW-PRESSURE DISCHARGE LAMP WITH COOLED INTERNAL BALLAST

This application is a continuation of Ser. No. 698,277 filed Feb. 5, 1985, which is a continuation of Ser. No. 548,054 filed Nov. 17, 1983, both of which are abandoned, which is a continuation of Ser. No. 294,868 filed Aug. 21, 1981, now U.S. Pat. No. 4,455,508.

BACKGROUND OF THE INVENTION

The invention relates to a low-pressure mercury vapor discharge lamp having, around an electric stabilization ballast which is necessary for the operation of the lamp, a discharge vessel which is closed in a vacuum-tight manner and which encloses electrodes between which a discharge is present during operation of the lamp. The discharge vessel contains mercury and a rare gas and is shaped and dimensioned such that the discharge path is curved in one or more places. Such a lamp is disclosed in U.S. Pat. No. 3,899,712.

This United States Patent discloses compact cylindrical low-pressure mercury vapor discharge lamps which can be placed in luminaires having holders for incandescent lamps for general lighting purposes. In the above-mentioned lamps the centrally positioned stabilization ballast is surrounded by the discharge vessel, which consists of two slightly tapered glass cylinders which bear against each other, a helical groove having been provided to form the discharge path in at least one of the cylinder walls.

A centrally positioned stabilization ballast makes it possible to reduce the dimension of the lamp to a minimum and to shape the lamp in such manner that it resembles an incandescent lamp. In the known lamp the stabilization ballast (consisting of, for example, a plurality of turns of insulated copper wire around a laminated iron core) is surrounded in such manner by the wall of the cylindrical discharge vessel that there is only a relatively small aperture at the top of the lamp. As a result thereof, because of a relatively poor ventilation, the temperature of the ballast can increase during operation of the lamp to an unwanted high value. Too high an operating temperature of the ballast results in deterioration of the insulation of the copper wire and in a reduced efficiency of the ballast. Added to this is the fact that the temperature in the discharge vessel increases during operation of the lamp to such a high value owing to heat radiation by the ballast that the optimum mercury vapor pressure for a highest possible conversion efficiency of electric power applied to the lamp into ultraviolet radiation is exceeded. This causes the luminous flux and the efficiency of the lamp to decrease.

SUMMARY OF THE INVENTION

The invention has for its object to provide a low-pressure mercury vapor discharge lamp having a discharge vessel which surrounds the ballast, the adverse effects due to heat generation in the ballast being avoided.

According to the invention, a low-pressure mercury vapor discharge lamp of the type described in the opening paragraph is characterized in that a thin-walled member of a heat-conductive material which bears on a major portion of the outer surface of the ballast is provided between the discharge vessel and the ballast, this body having a collar which extends as far as the surface of the discharge vessel remote from the ballast, to dissipate the heat generated by the ballast to the surrounding atmosphere.

During operation the temperature in the discharge vessel and in the ballast of a lamp of the invention remains at such a value that the efficiency of the lamp (the ballast included) is as advantageous as possible. The operating life of the lamp is not adversely affected by untimely failure of the ballast owing to a high operating temperature. Heat radiated by the ballast is unable to cause the mercury vapor pressure in the discharge vessel to increase to an excessively high value.

A block-shaped ballast consisting of a laminated iron core having a coil of insulated copper wire is often used in the lamp. The thin-walled member (the heat sink) bears upon substantially all the consecutive edges of the iron lamellae. Consequently, the heat flow can be rapidly dissipated by the heat sink. This is particularly of interest for (frequently used) ballasts in which a thin insulating layer is provided between two consecutive lamellae which would strongly impede the flow of heat (without an abutting cooling body) in the direction perpendicular to the major surfaces of the lamellae. In a lamp of the invention substantially every lamella is in thermal contact with the heat sink, so that adequate heat dissipation is produced from the entire surface of the ballast. Satisfactory results have been obtained with a thin-walled heat sink which bears on at least 75% of the total outer surface of the ballast.

The collar necessary for the dissipation of heat to the surrounding atmosphere of the lamp is secured, for example, by means of a spot welded or cemented connection, as a separate component to the portion of the body which surrounds the ballast. In an embodiment the collar forms one whole with the remaining portion of the heat sink bearing on the ballast. In that embodiment the collar is, for example, a folded portion of the wall of a cylinder or can be made from an aluminum plate and positioned around the entire ballast. Such cans can be easily mass-produced. Aluminum is easy to deform, has a low weight and is a good heat conductor. In a practical embodiment the collar also forms, for example, part of the wall of a lamp base which includes, for example, a starter. The collar then engages around the discharge vessel portion which is located near the lamp base and extends as far as the outer circumference of the discharge vessel (which forms, for example, at the same time the outer wall of the lamp), causing the dissipation of heat both by radiation and convection to be as advantageous as possible. In that region the collar may, for example, be provided with a corrugated surface or with other means to increase the heat radiation, such as an organic lacquer applied onto the exterior wall of the collar, which lacquer also makes the lamp safer to touch.

It has been found that in lamps having a shape in accordance with German Offenlegungsschrift No. 2,904,864 (which corresponds to U.S. Pat. No. 4,260,931) wherein the ballast is enclosed by a dome-shaped discharge vessel, a temperature difference of approximately 20° C. could be achieved between the temperature of the ballast (hottest place) and the temperature of the exterior wall of the collar. Also in lamps having a shape in accordance with German Offenlegungsschrift No.2,942,846 (which corresponds to U.S. Pat. No. 4,546,284) wherein a centrally positioned ballast is enclosed by a folded tubular discharge vessel which is enclosed by an outer bulb, a comparable temperature difference has been realized by means of a can with collar, this can enclosing the whole ballast (the collar gripping around the outer bulb wall).

In an embodiment of a low-pressure mercury vapor discharge lamp of the invention a thin layer of electrically insulating material (for example a thin film of nylon) to make the lamp safer to touch by hand has been provided between the wall of the body and the surface of the ballast. No additional provisions on the exterior wall surface of the collar are then necessary.

In a second embodiment of a lamp of the invention a reflecting layer (consisting of, for example, titanium dioxide) is provided on the wall portion of the body which faces the discharge vessel to increase the luminous flux of the lamp.

In a further embodiment of a lamp of the invention a portion of the wall of the collar of the heat sink has such a shape, that it bears locally on an appendage in the discharge vessel wall, this appendage containing an amalgam (for example an amalgam consisting of mercury, indium and bismuth). The good heat-conducting properties of the heat sink are used to keep the wall of the appendage of the discharge vessel at a relatively low temperature. During operation the mercury vapor pressure in the discharge vessel is kept at the above-mentioned constant value (approximately $6\times10^{-3}$ torr) by means of the amalgam on the comparatively cool wall of the appendage. To cool the wall of the appendage the collar of the thin-walled member is provided with, for example, a metal tape or foil which grips around the appendage. It is alternatively conceivable that a cured heat-conducting paste or cement is provided for this purpose between the wall of the body and the appendage. In a practical embodiment there is a skein or pellet of aluminum foil.

Lamps of the invention are an alternative for incandescent lamps, particularly in places and in luminaires where the temperatures may rise to rather high values owing to poor ventilation. The efficiency of the lamps of the invention is not only advantageous compared with incandescent lamps but also when compared with other compact discharge lamps.

The invention will now be further described with reference to the accompanying drawings which show one of the various embodiments of a lamp in accordance with the invention.

DESCRIPTION OF THE PREFERRED EMBODIMENT

Figure 1:
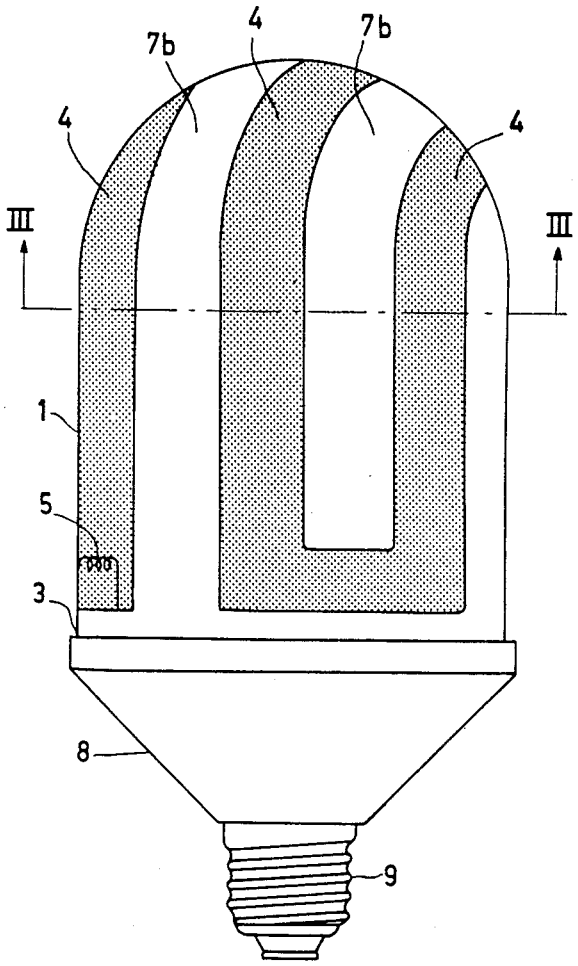
FIG. 1 is an elevational view of a lamp according to the invention.
Figure 2:
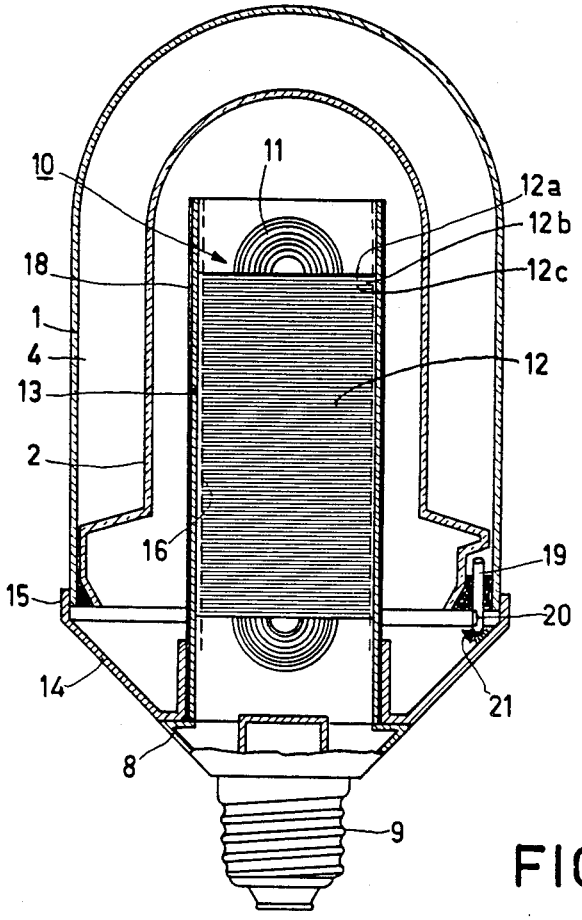
FIG. 2 shows a longitudinal cross-section through a lamp of FIG. 1.
Figure 3:
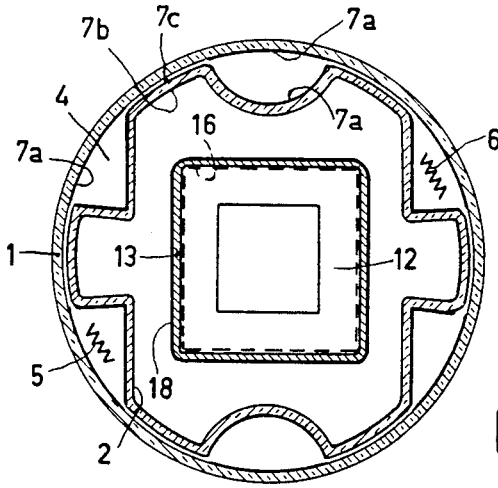
FIG. 3 shows a cross-sectional view on the plane III—III of a lamp FIG. 1.

Referring now to FIGS. 1, 2 and 3, the lamp shown comprises a cylindrical discharge vessel 1, one end of which is closed in a dome-shaped manner, the discharge vessel enclosing an electric ballast which is necessary for the operation of the lamp. FIG. 1 shows only the outer wall of the discharge vessel. This outer wall is at the same time the outer wall of the lamp.

The lamp further comprises an inner wall 2, one end of which is closed in a generally dome-shaped manner; the discharge vessel is enclosed by the walls 1 and 2. These walls 1 and 2 are connected to each other in a gas-tight manner (for example by means of glass enamel) in the region of the edge 3 of the cylindrical discharge vessel 1. The wall 2 has a groove 4, which is curved in a plurality of places causing the discharge path to be folded between the electrodes 5 and 6. Electrode 6 is not shown in FIG. 1. The discharge path is limited by the wall of the groove 4 in wall 2 and the portions of wall 1 which face the groove 4. (The discharge path is shown in FIG. 1 as a dark stripe). In a practical embodiment only the wall portions facing the discharge path are coated with a luminescent layer (shown in FIG. 3 as a thick line *7a*), while the intervening portions (such as *7b*) of the wall 2 between the groove portions 4 and the portion *7c* of wall 1 facing them (which portions are located at a very small distance from each other and define a gap) are free from luminescent material. Such a lamp is disclosed in German Offenlegungsschrift No. 2,904,864.

The discharge vessel further contains mercury and a rare gas. The lamp further comprises a lamp base 8 with threaded sleeve 9, so that the lamp is suitable for use in incandescent lamp sockets. The lamp base 8 may for example enclose a starter. The electric stabilization ballast 10 (see FIG. 2) consists of a plurality of turns of insulated copper wire 11 around a laminated iron core 12. The ballast is fully enclosed by the wall of the discharge vessel and the wall of the lamp base.

Between the wall 2 and ballast 10 is a thin rectangular tube 13 serving as heat sink of a heat-conducting material such as aluminum, which bears on a largest possible portion of the outer surface of the ballast. In this embodiment, the tube 13 bears on approximately 85% of the outer surface of the ballast, which is formed by the edges of the lamellae (a few of them denoted, by way of example as 12*a*, 12*b*, 12*c*). The tube is provided with an aluminum collar 14 having the general shape of a truncated cone which extends to surround the edge of the discharge vessel wall 1, the collar being connected at its apex to the wall of tube 13. In this manner the heat generated in the ballast is dissipated to the surrounding atmosphere during operation of the lamp such that the body functions as a heat sink.

The collar further has an annular lip 15 by means of which the tube is connected to the discharge vessel. The base 8 is also connected to the collar. In order to make the lamp safe when touched by hand, an electrically insulating synthetic resin (such as nylon) material film 16 (shown in the drawing by means of a broken line) which is approximately 0.2 mm thick has been provided between the wall of tube 13 and the iron core 12. The film hardly impedes the heat dissipation as the largest possible area of the tube 13 bears on the ballast. The material of the film is chosen so that the temperature gradient between the ballast and the tube measured across the foil surfaces is small.

The exterior wall of the aluminum tube 13 is coated with a reflecting layer of titanium dioxide 18 to increase the luminous flux of the lamp. In one embodiment the wall of tube 13 is provided in the region of the discharge path with a special, conducting layer (comprising for example $SnO_2$) to facilitate starting of the lamp.

A portion of the wall of collar 14 extends to near an appendage 19 in the wall of the discharge vessel, this appendage containing an amalgam 20 which keeps the mercury vapor pressure in the discharge vessel at an optimum constant value. This appendage is part of an exhaust tube which is used during manufacture of the lamp for evacuation of the discharge vessel. The wall of appendage 19 is kept by the wall of collar 14 at a temperature which is advantageous for providing an optimum mercury vapor pressure, by means of a pellet 21 of aluminum foil pushed between the wall of the appendage and the wall of the collar 14. Such a pellet has the advantage that it properly encloses the appendage wall and that it is a good heat conductor. The amalgam 20 consists of, for example, an alloy of indium and bismuth.

In a practical embodiment of a lamp of the invention the overall length of the lamp (including the lamp base) was approximately 10 cm. The outside diameter of the lamp envelope was approximately 6 cm. Folding the groove containing the discharge path in a relatively large number of places (for example in three places, near the lamp base) results in an overall length of the discharge path of approximately 40 cm. The dimensions of the ballast were 34.0×34.0×50 mm. The dimensions of the tubular portion of the aluminum heat sink 13 were 34.5×34.5×65 mm and the wall was approximately 1 mm thick. With a power of 20 W applied to the lamp and ballast, the energy dissipation in the ballast was approximately 6.5 W, the temperature difference $\Delta T$ between the hottest spot in the ballast (in the region of the coil) and the exterior surface of the collar being approximately 20° C. A thin synthetic resin material film, approximately 0.2 mm thick, was provided between the wall of the heat sink 13 and the ballast, to make touching the lamp safer.

In the claims describing the apparatus in accordance with the invention, the term "axial" has been used. This term will be understood to refer to a direction along the geometric axis of the lamp. The "geometric axis" of the lamp will be understood to refer to a line about which the lamp is substantially symmetrical.

What is claimed is:

1. A low-pressure metal-vapor discharge lamp having an outside wall surface, comprising:

a discharge vessel having a geometric axis, and being closed in a vacuum-tight manner;

a quantity of rare gas and vaporizable metal contained in said vessel;

electrodes disposed in said discharge vessel, said vessel and electrodes being arranged and dimensioned such that during operation of the lamp a discharge is present along a discharge path between said electrodes, said discharge path being curved in one or more places; and a stabilization ballast having an outer surface, said discharge vessel being disposed around at least a major part of said ballast outer surface;

characterized by comprising an elongated thin-walled member having an axis, made of a heat-conductive metal material disposed in heat-conducting relation with a major portion of the outer surface of said ballast, substantially all of said thin-walled member being intermediate said ballast and said discharge vessel;

an electrically insulating layer disposed between the wall of said thin-walled member and said ballast; and a heat-conductive metal collar extending from said thin-walled member to the outside wall surface of said lamp, said collar being in thermal contact with an axial portion of said thin-walled member, wherein during operation heat generated by the ballast is dissipated via said thin-walled member and collar to said lamp outer surface.

2. A lamp as claimed in claim 1, characterized in that said collar engages said discharge vessel.

3. A low-pressure metal-vapor discharge lamp having an outside wall surface, comprising:

a discharge vessel having a geometric axis, being closed in a vacuum-tight manner, and having an outside surface which constitutes a major portion of said outside wall surface of the lamp;

a quantity of rare gas and vaporizable metal contained in said vessel;

electrodes disposed in said discharge vessel, said vessel and electrodes being arranged and dimensioned such that during operation of the lamp a discharge is present along a discharge path between said electrodes, said discharge path being curved in one or more places;

a stabilization ballast having an outer surface, said discharge vessel being disposed around at least a major part of said ballast outer surface; and a base having a screw type element for mounting and making electrical connections to the lamp, said screw type element and said ballast being substantially coaxial with said vessel geometric axis characterized by comprising an elongated thin-walled member having an axis, made of a heat-conductive metal material disposed in heat-conducting relation with a major portion of the outer surface of said ballast, substantially all of said thin-walled member being intermediate said ballast and said discharge vessel; and a heat-conductive metal collar extending from said thin-walled member to and forming part of the outside wall surface of said lamp, said collar being in thermal contact with an axial portion of said thin-walled member, and mechanically connecting said base to said vessel, whereby during operation heat generated by the ballast is dissipated via said thin-walled member and collar to said lamp outer surface.

4. A lamp as claimed in claim 3, characterized in that said collar has an annular lip which surrounds and is connected to an edge of said discharge vessel, whereby said collar connects the thin-walled member to the vessel.

* * * * *